United States Patent [19]

Thudium et al.

[11] Patent Number: 5,048,318

[45] Date of Patent: Sep. 17, 1991

[54] INTERMEDIATE DEPOSITING STATION BETWEEN MACHINING STAGES OF A PRESS

[75] Inventors: Karl Thudium, Wäschenbeuren; Walter Rieger, Göppingen, both of Fed. Rep. of Germany

[73] Assignee: L. Schuler GmbH, Fed. Rep. of Germany

[21] Appl. No.: 580,967

[22] Filed: Sep. 12, 1990

[30] Foreign Application Priority Data

Sep. 18, 1989 [DE] Fed. Rep. of Germany ..... 3931081

[51] Int. Cl.[5] ..... B21D 45/05

[52] U.S. Cl. ..... 72/405; 72/419

[58] Field of Search ..... 72/405, 419, 426; 269/56, 58, 71; 414/749; 198/621; 29/568

[56] References Cited

U.S. PATENT DOCUMENTS

| | | | |
|---|---|---|---|
| 3,855,840 | 12/1974 | Kawano | 72/419 |
| 3,875,808 | 4/1975 | Okamoto et al. | 74/29 |
| 4,641,515 | 2/1987 | Brawn | 72/405 |
| 4,713,961 | 12/1987 | Hoehn | 72/405 |
| 4,730,825 | 3/1988 | Mikusch et al. . | |

FOREIGN PATENT DOCUMENTS

| | | | |
|---|---|---|---|
| 325841 | 8/1989 | European Pat. Off. | 72/419 |
| 100927 | 6/1983 | Japan | 72/426 |
| 238252 | 11/1985 | Japan | 269/56 |
| 24927 | 2/1987 | Japan | 269/56 |

*Primary Examiner*—Daniel O. Crane

*Attorney, Agent, or Firm*—Evenson, Wands, Edwards, Lenahan & McKeown

[57] ABSTRACT

An intermediate depositing station between machining stages of a metal forming machine, having templates for supporting a sheet metal part from below which are adjustable in height, distance and oblique position relative to another sheet metal part. The intermediate depositing station has a mounting plate that is displaceable in a first horizontal direction with respect to a foundation. A first adjusting device is coupled to the mounting plate and is operable to displace the mounting plate horizontally. A carriage plate is coupled to the mounting plate and is displaceable in a second horizontal direction that is transverse to the first horizontal direction. A second adjusting device is coupled to the carriage plate and is operable to displace the carriage plate horizontally. A console is coupled vertically on the carriage plate. A third adjusting device is coupled to the console and is operable to lift and lower the console. The intermediate depositing station has a pivot bearing on the console, and a fifth adjusting device pivoted in the pivot bearing and having an output. A bracket is coupled to the fifth adjusting device. A fourth adjusting device is coupled to the fifth adjusting device via the bracket and is operable to pivot the fifth adjusting device. Supporting brackets couple the fifth adjusting device output to the templates, the fifth adjusting device being rotationally drivable in forward and reverse directions.

5 Claims, 4 Drawing Sheets

INTERMEDIATE DEPOSITING STATION BETWEEN MACHINING STAGES OF A PRESS

BACKGROUND AND SUMMARY OF THE INVENTION

The present invention relates to an intermediate depositing station between machining stages of a press, press line, a hybrid press system and other similar metal forming machines, and more specifically, to an intermediate depositing station having templates for supporting sheet metal parts from below which, by means of adjusting and movement deflecting devices, can be adjusted in their height, distance, and oblique position to another sheet metal part.

Intermediate depositing stations are arranged in the no-load stages of presses in order to bridge the distance between the machining stages. A transfer press having no-load stages in the frame areas is shown, for example, in U.S. Pat. No. 3,875,808. Furthermore, an intermediate depositing station is shown in the U.S. Pat. No. 4,730,825 where the bearing surface, which may also be formed by templates, is adjustable in its height. Likewise, the size of the bearing surface and the distance of the templates with respect to one another may be adjusted by means of a motor.

In contrast, it is an object of the invention to position the sheet-metal part which, in each case, is inserted into the intermediate depositing station, with respect to the subsequent machining stage and to compensate swivelling errors caused by swivelling movements that may be required.

This and other objects are achieved by the present invention which provides an intermediate depositing station between machining stages of a metal forming machine, comprising templates for supporting a sheet metal part from below which are adjustable in height, distance and oblique position relative to another sheet metal part. The intermediate depositing station has a mounting plate that is displaceable in a first horizontal direction with respect to a foundation. A first adjusting device is coupled to the mounting plate and is operable to displace the mounting plate horizontally. A carriage plate is coupled to the mounting plate and is displaceable in a second horizontal direction that is transverse to the first horizontal direction. A second adjusting device is coupled to the carriage plate and is operable to displace the carriage plate horizontally. A console is coupled vertically on the carriage plate. A third adjusting device is coupled to the console and is operable to lift and lower the console. The intermediate depositing station has a pivot bearing on the console, and a fifth adjusting device pivoted in the pivot bearing and having an output. A bracket is coupled to the fifth adjusting device. A fourth adjusting device is coupled to the fifth adjusting device via the bracket and is operable to pivot the fifth adjusting device. Supporting brackets couple the fifth adjusting device output to the templates, the fifth adjusting device being rotationally drivable in forward and reverse directions.

An advantage of an intermediate depositing station constructed in accordance with an embodiment of the present invention is that it can be adjusted automatically to different tool sets. With the setting-up for a new sheet metal part, the values which were determined during the first setup and were stored electronically are reset.

Other objects, advantages and novel features of the present invention will become apparent from the following detailed description of the invention when considered in conjunction with the accompanying drawings.

DETAILED DESCRIPTION OF THE DRAWINGS

Figure 1:
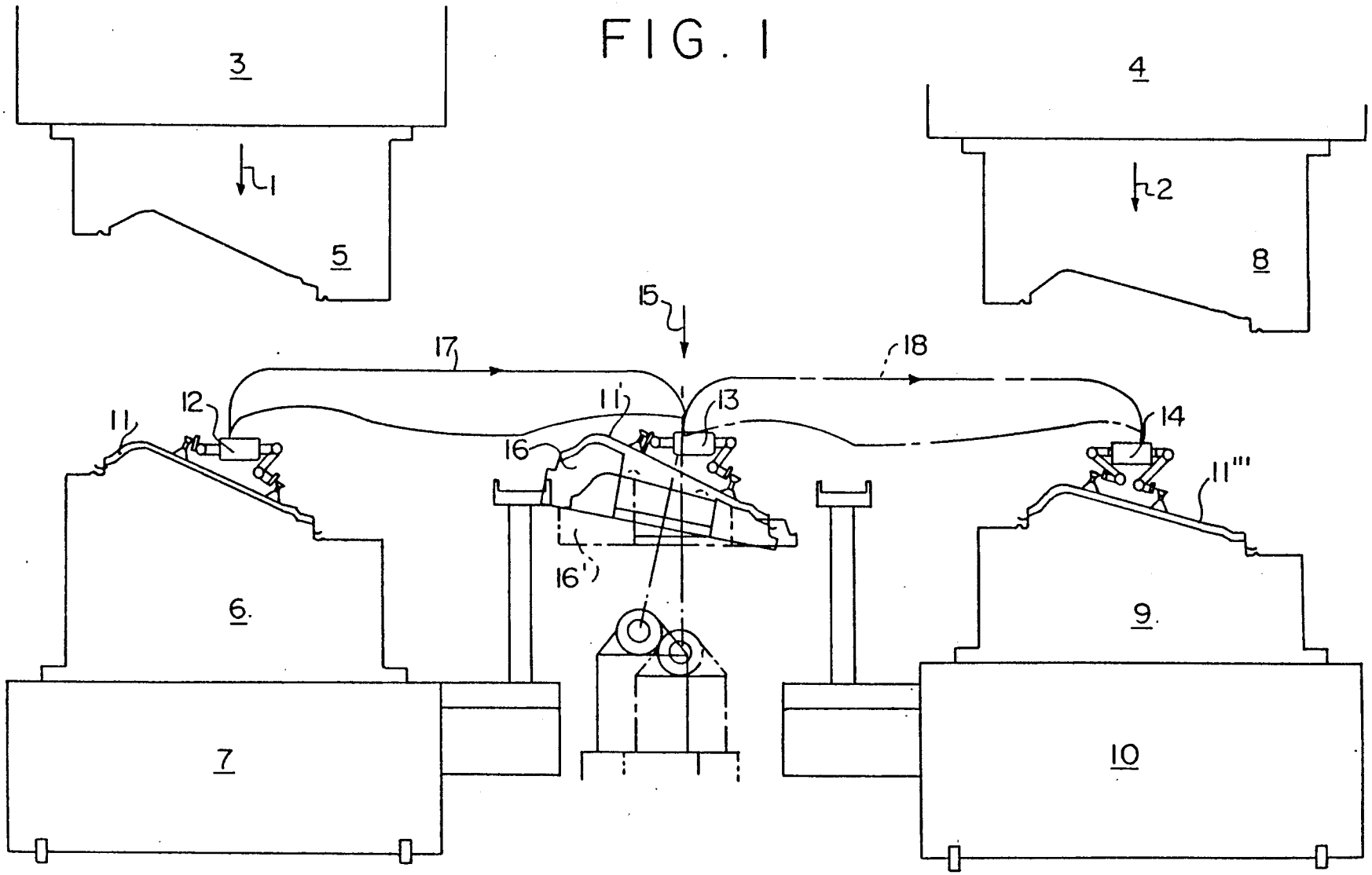
FIG. 1 is a view of a partially shown intermediate depositing station arranged between two machining stages of a press constructed in accordance with an embodiment of the present invention.
Figure 2:
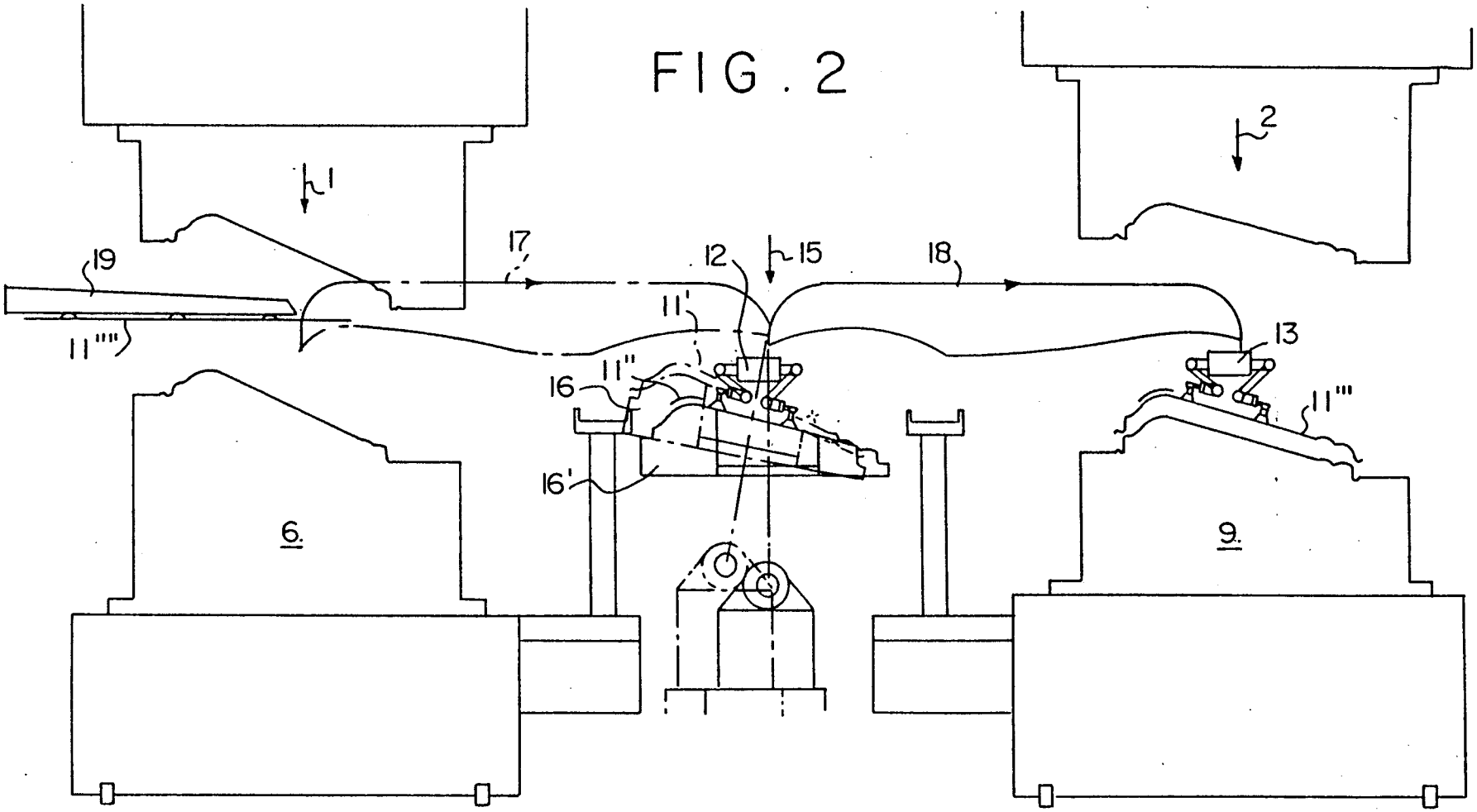
FIG. 2 is a view of the intermediate depositing station of FIG. 1 that illustrates the transfer movements.

FIGS. 1 and 2 show two machining stages of a press which have the reference numbers 1 and 2. Reference numbers 3 and 4 indicate slides which move upper tool parts 5 and 8 against lower tool parts 6 and 9, for the forming of sheet metal parts 11, 11'''. The tools 5, 6 and 8, 9 can be exchanged by means of sliding tables 7, 10.

The transporting of the sheet metal parts 11, 11''' takes place via suction spiders 12, 13 with transfer movements 17, 18. Suction spider 14 is used for the transfer of sheet metal part 11''' into the next intermediate depositing station (not shown).

An intermediate depositing station has the reference number 15 and has templates 16 for the depositing and removal of the sheet metal parts 11. The templates 16, by means of adjusting devices and movement deflecting devices, which will be described in detail in the following, can be moved, for example, into the shown position 16'. Suction spider 12 removes a formed sheet metal part 11 from machining stage 1 and deposits it in the intermediate depositing station 15 on the templates 16. Suction spider 13 removes the sheet metal part 11'' which had previously been swivelled into the intermediate depositing station 15 and deposits it in machining station 2. The swivel movements and the correcting movements of the templates 16 take place during the time period of the transfer movement of the sheet metal parts 11. During this time period, a new sheet metal part 11'''' can be placed in machining stage 1 by an inserting feeder 19 (FIG. 2).

Figure 3:
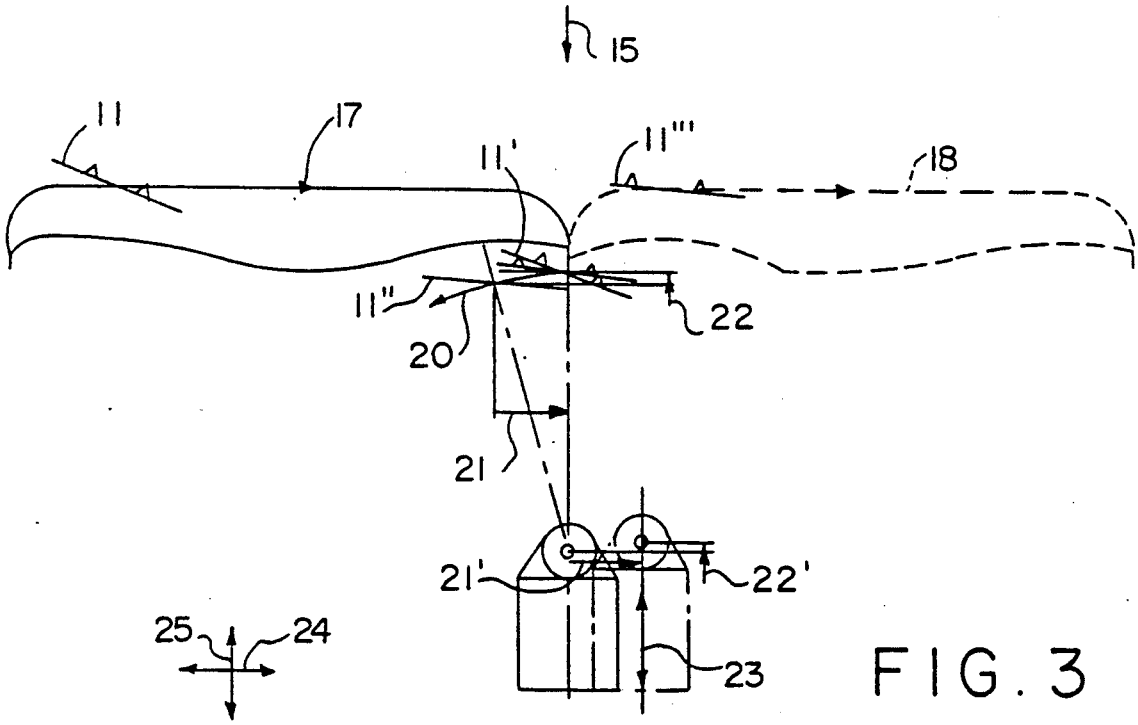
FIG. 3 is a simplified representation of the transfer movements of the sheet metal parts and of the aligning and correcting movements of the intermediate depositing station required for the alignment to the next machine stage.

In FIG. 3, a sheet metal part which is in the transfer movement has the reference number 11 and is shown in the oblique position from machining stage 1. Reference number 11''' indicates a sheet metal part during the transfer movement 18 in an oblique position for the depositing in the machining stage which follows. This new oblique position is caused by a swivel motion 20 of the templates 16 so that the sheet metal part moves from position 11' into position 11''. The swivel motion 20 results in a displacement of the center of the sheet metal part 11 which must be compensated by a horizontal correcting movement 21 (performed by movement of the templates 16 in the direction 21') and by a vertical correcting movement (performed by movement of the templates 16 in the direction 22').

Since it is possible for differences in height as well as lateral offsetting to occur between tool 5, 6 of machining stage 1 and tool 8, 9 of machining stage 2 (see FIG. 1) which follows (eccentricity), additional movements can be carried out for one vertical movement 23 and for two horizontal movements 24, 25 (as seen in top view in FIG. 3). The position of the center of gravity of the sheet metal part, which changes in the preform stage—here the first machining stage 1—may be compensated by corresponding horizontal movements with respect to the suction spiders 12, 13. The electric or electronic control for these movements may take place, for example, by means of a well-known program control, such as shown in German Patent Document 27 47 238 Al.

Figure 5:
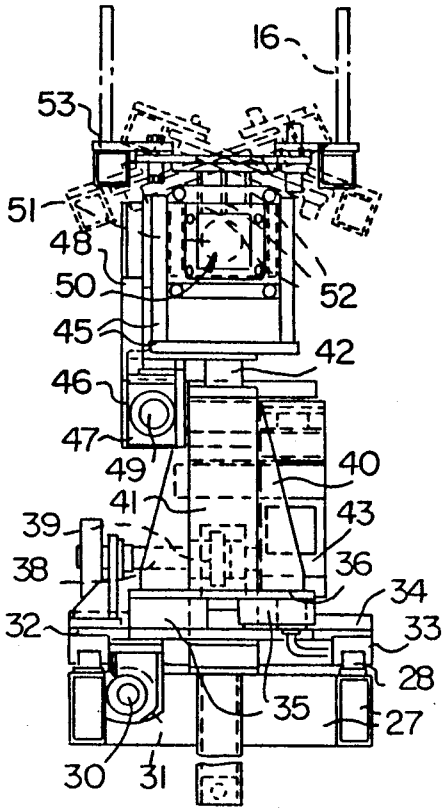
FIG. 5 is a lateral view of the intermediate depositing station illustrated in FIG. 4.
Figure 4:
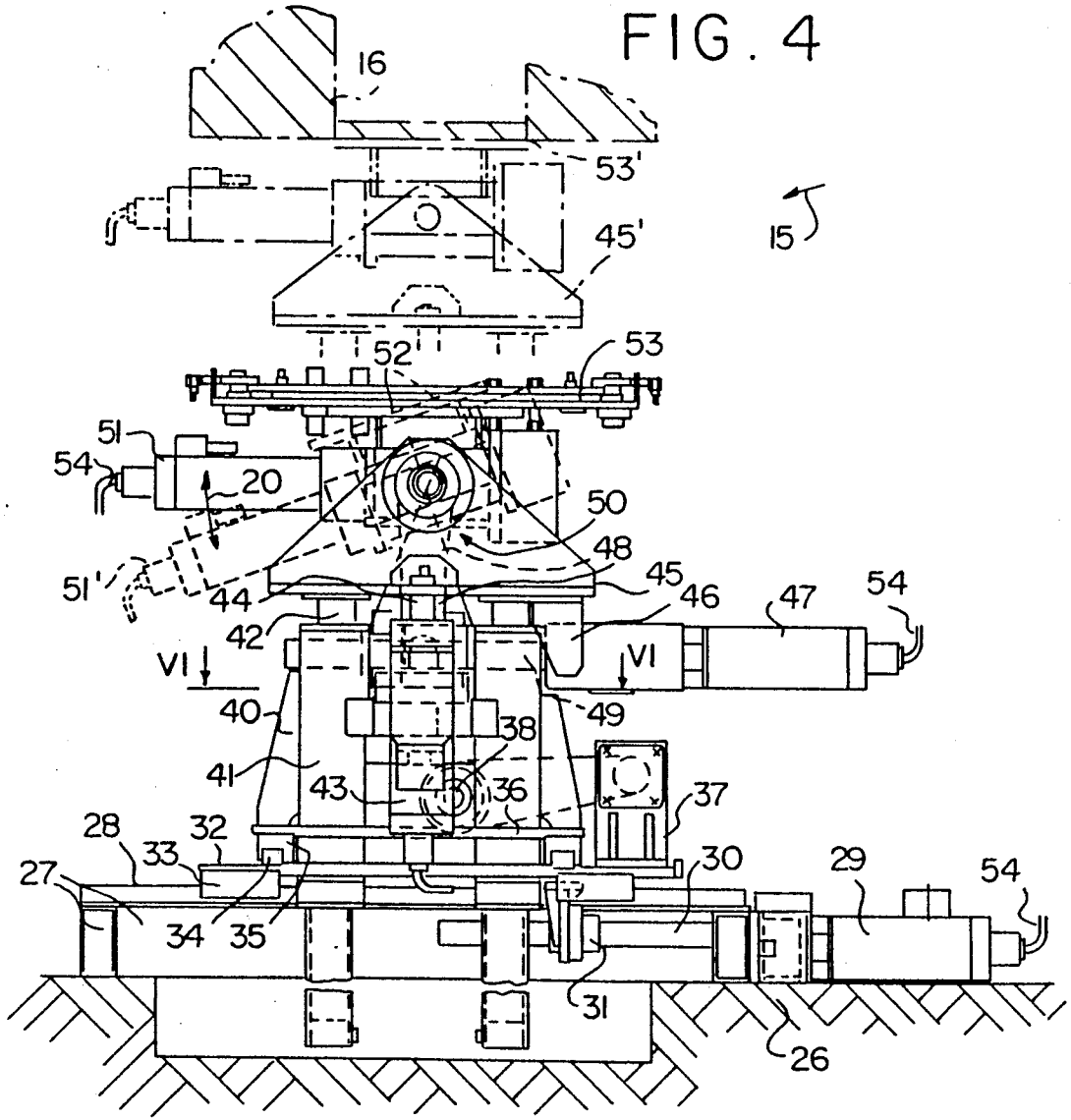
FIG. 4 is a front view of an intermediate depositing station.
Figure 6:
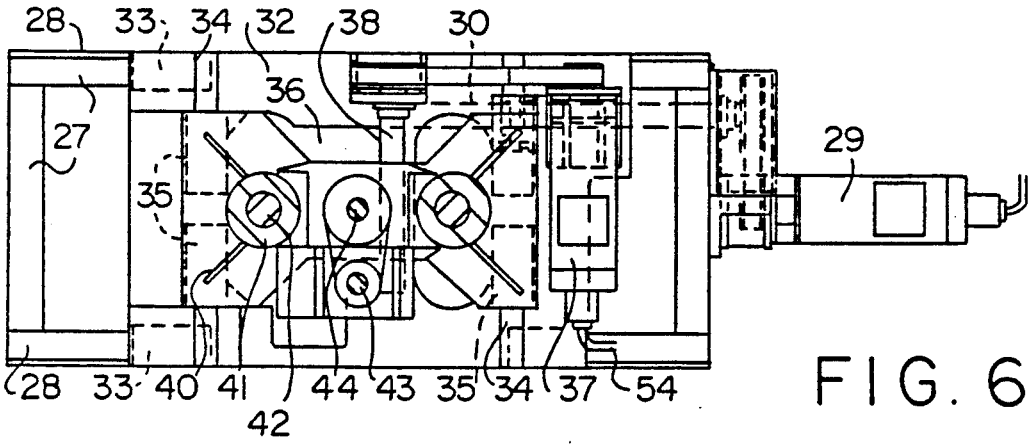
FIG. 6 is a top view of the intermediate depositing station according to section VI—VI of FIG. 4.

FIGS. 4, 5 and 6 show an intermediate depositing station 15 in detail. A frame 27 is fixedly placed on a foundation 26. The frame 27 has guide rails 28 as well as a motor 29 for the longitudinal movement (horizontal) of a mounting plate 32 that can be displaced in the guide rails 28. Reference numeral 30 indicates a spindle and 31 a split nut for the transmission of movement from the motor 29 to the mounting plate 32. Guides of the mounting plate 32 have the reference number 33.

On the mounting plate 32, a carriage plate 36 can be displaced in guide rails 34 and guides 35 in a horizontal direction that is transverse to the moving direction described above. This transverse horizontal movement is carried out by means of a motor 37 fixed to the mounting plate 32, a spindle 38 which is rotationally driven by the motor 37, and a split nut 39 fixed to the carriage plate 36.

In supporting frames 40, the carriage plate 36 carries guide columns 41 in which guide rods 42 are disposed in a vertically movable manner. A console 45 can be lifted and lowered by means of the guide rods 42. The lifting and lowering movement of the console 45 is caused by a motor 43 which is vertically arranged at the carriage plate 36 and the spindle 44 of which is applied to the console 45.

A pivot bearing 50 is provided at the console 45. An adjusting device 51 is pivoted in the pivot bearing 50 (pivotal movement 20). A second position of the adjusting device 51 is shown in dashed lines and has the reference number 51'. The pivotal movement originates from an adjusting device 47. The adjusting device 47 is fastened to the console 45 by holding plates 46 and is applied to adjusting device 51 via a rod 49 and a bracket 48.

The adjusting device 51 is applied directly to the supporting brackets 52 for their rotational adjustment about the center axis of the adjusting device 51. Template carriers 53 are fastened to the supporting brackets 52 for the templates 16 indicated in FIG. 4 in a lifted position. Reference number 54 indicates the general position of connections by means of which the motors and the adjusting devices 29, 37, 43, 51 can be controlled corresponding to the indicated circuit structure.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A metal forming machine comprising:

a plurality of machining stages for machining sheet metal parts; and an arrangement for the temporary intermediate depositing and pivoting of individual sheet metal parts during a transfer from one machine stage to a next machining stage of the metal forming machine, said arrangement including:

templates for supporting a sheet metal part from below which are adjustable in height, distance and oblique position relative to another sheet metal part;

a mounting plate displaceable in a first correcting movement in a first horizontal direction with respect to a foundation after pivoting of the sheet metal part from a first position in which the sheet metal part is placed on the templates into a second position in which the sheet metal part is removed from the templates;

a first adjusting device coupled to the mounting plate and operable to displace said mounting plate horizontally;

a carriage plate coupled to the mounting plate and displaceable in a second horizontal direction that is transverse to the first horizontal direction;

a second adjusting device coupled to the carriage plate and operable to displace said carriage plate horizontally;

a console coupled vertically on said carriage plate;

a third adjusting device coupled to the console and operable to lift and lower said console in a second correcting movement after pivoting of the sheet metal part from the first position in which the sheet metal part is placed on the templates and the second position in which the sheet metal part is removed from the templates;

a pivot bearing on the console;

a fifth adjusting device pivoted in the pivot bearing and having an output;

a bracket coupled to the fifth adjusting device;

a fourth adjusting device coupled to the fifth adjusting device via said bracket and operable to pivot the fifth adjusting device and thereby pivot the sheet metal part from the first position in which the sheet metal part is placed on the templates to the second position in which the sheet metal part is removed from the templates;

supporting brackets coupling the fifth adjusting device output to the templates, the fifth adjusting device being rotationally drivable in forward and reverse directions.

2. The metal forming machine according to claim 1, wherein the fifth adjusting device is directly connected to the templates by the supporting brackets.

3. The metal forming machine according to claim 1, further comprising template carriers coupled between the supporting brackets and the templates.

4. The metal forming machine according to claim 1, further comprising: a frame to be fixedly placed on a foundation; rails extending on an upper side of said frame, said rails extending in a direction of transfer movement of the sheet metal parts through the metal forming machine and guiding the mounting plate; a rotationally driven spindle coupled to the first adjusting device and extending in parallel to the rails; a split nut fixedly coupled to the mounting plate and cooperating with the rotationally driven spindle, said first adjusting device affecting movement of the mounting plate via said split nut and said rotationally driven spindle.

5. The metal forming machine according to claim 1, wherein the second adjusting device is fastened to the mounting plate and the mounting plate has rails, said carriage plate being guided in said rails, and further comprising a split nut coupled to the carriage plate, a spindle coupled to the second adjusting device and rotationally driven by the second adjusting device to act upon the split nut coupled to the carriage plate to move said carriage plate.

* * * * *